United States Patent [19]

Chard et al.

[11] Patent Number: 4,848,374

[45] Date of Patent: Jul. 18, 1989

[54] SMOKING DEVICE

[76] Inventors: Brian C. Chard, 12 Ilchester Rd., Bedminster Down, Bristol, England, BS137JA; Christopher R. Bale, 10 Kelston Rd., Keynsham, Bristol, England, BS18 2UH; Beresford R. Gill, 8 Mendip Rd., Portishead, Bristol, England, BS20 8AA; David Herron, 52 Hampton Park, Redland, Bristol, England, BS6 LJ; Stephen J. Garrett, Campion, Lydford-on-Fosse, Somerton, Somerset, England, TA11 7HA

[21] Appl. No.: 204,863

[22] Filed: Jun. 10, 1988

[30] Foreign Application Priority Data

Jun. 11, 1987 [GB] United Kingdom ..... 8713645

[51] Int. Cl.[4] ..... A24D 1/00; A24D 3/02; A24F 5/00; A24F 5/04

[52] U.S. Cl. ..... 131/330; 131/187; 131/194; 131/195; 131/198.1

[58] Field of Search ..... 131/273, 271, 198.1, 131/198.2, 194, 195, 335, 347, 359, 330, 187

[56] References Cited

U.S. PATENT DOCUMENTS 4,149,548 8/1979 Bradshaw ..... 131/273
4,474,191 10/1984 Steiner ..... 131/198.1

*Primary Examiner*—V. Millin
*Assistant Examiner*—D. Crosby
*Attorney, Agent, or Firm*—Larson and Taylor

[57] ABSTRACT

A smoking device for releasing an aerosol into the mouth of a smoker comprises in combination, a chamber into which a mixture of air and a liquid aerosol precursor is introduced, a heat source surrounding the chamber, a first duct providing communication between the chamber and a smoker's mouth, whereby the contents of the chamber may be drawn into the smoker's mouth, a container for the aerosol precursor, a second duct means leading from the aerosol precursor container into the chamber whereby aerosol precursor may pass from said container into the chamber, and a third duct means providing communication between ambient air and the chamber whereby ambient air may be drawn into the chamber by the smoker, the arrangement being such that in operation liquid aerosol precursor entering the chamber is converted into a condensation aerosol.

23 Claims, 2 Drawing Sheets

SMOKING DEVICE

Figure 1:
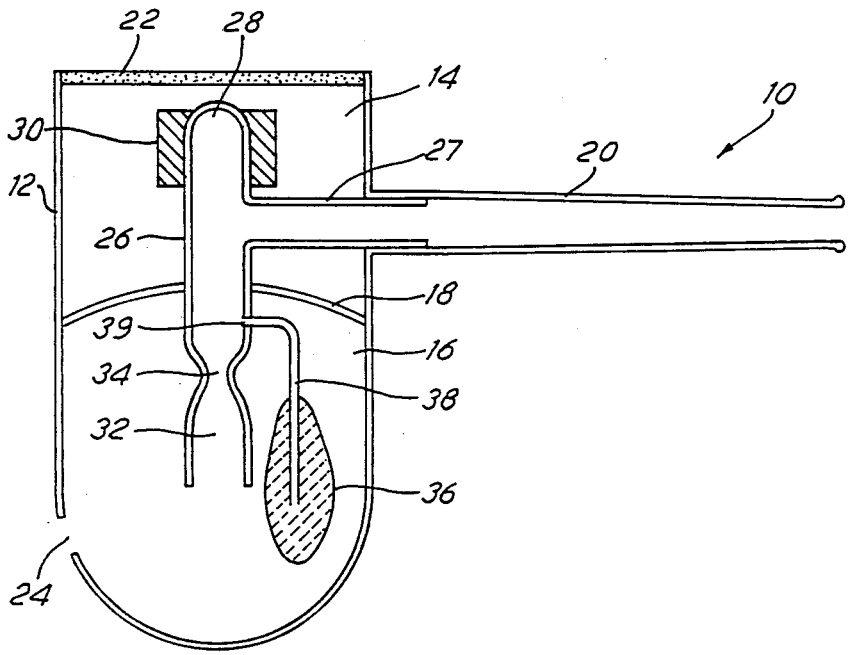

The present invention concerns a smoking device.

Among the reasons why many people smoke conventional cigarettes or a tobacco pipe is that they wish to inhale an aerosol that contains nicotine. However, when a cigarette is smoked, some nicotine is lost to the smoker by pyrolysis and some is lost in sidestream smoke, mainly during smoulder between puffs.

The present invention provides a smoking device in which the loss of nicotine to the smoker by pyrolysis and in sidestream smoke is substantially avoided.

A prior art smoking device which aims at minimising the above-mentioned disadvantage is described in U.S. Pat. No. 3,356,094 in the name of C.D. Ellis et al. This smoking device comprises a tube formed of tobacco having a mouthpiece attached at one end. An axial inner tube of material which is frangible under heat is contained within the tobacco tube and is coated on its inner surface with nicotine. Thus, on smoking, hot gases are drawn up the inner tube and, acting on the nicotine, release the nicotine in the form of an aerosol for inhalation by the smoker. However, appreciable loss of nicotine and other desirable compounds such as flavourants during smoking is not entirely prevented.

A further prior art smoking device described in British Patent No. 2064296 (Imperial Tobacco Limited) has an annular fuel rod with longitudinal bore in gaseous communication with a mouth-end chamber. The chamber contains a quantity of inhalant material which, when contacted by hot gases during smoking forms an aerosol for inhalation by the smoker.

Also, a smoking device described in European Patent Application No. 174645 (R.J. Reynolds Tobacco Company) comprises a short combustible carbonaceous fuel element, a heat stable substrate bearing an aerosol forming substance (aerosol generating means), a heat conducting member which contacts a portion of the fuel element and the substrate, and an insulating jacket surrounding at least a portion of the fuel element, the object being to provide a smoke-like aerosol which is chemically simple, consisting essentially of air, oxides of carbon, water, and the aerosol which carries any desired flavourants or other desired volatile materials.

These devices do not suffer the disadvantages of U.S. Pat. No. 3,356,094 in that nicotine and other desirable compounds such as flavourants are not substantially lost during smoulder. However, yields of mainstream aerosol available to the smoker are generally not as high as in conventional cigarettes.

It is an objective of the present invention to provide a smoking device that attains the above-mentioned objectives of the prior art while affording scope to generate relatively higher yields of mainstream aerosol. A particular feature of the present invention is that heat required to vaporise aerosol precursor, an event which precedes condensation to mainstream aerosol, is essentially transferred to the aerosol precursor by contact with heated surfaces rather than with hot gases as in the devices of the prior art.

According to the present invention there is provided a smoking device for releasing an aerosol into the mouth of a smoker, the device comprising in combination, (a) a chamber into which a mixture of air and an aerosol precursor is introduced, (b) a heating means external of the chamber for heating internal surfaces of the chamber, (c) a first duct providing communication between the chamber and a smoker's mouth, whereby the contents of the chamber may be drawn into the smoker's mouth, (d) a container for an aerosol precursor, (e) a second duct means leading from the aerosol precursor container into the chamber whereby aerosol precursor may pass from said container into the chamber, and (f) a third duct means providing communication between ambient air and the chamber whereby ambient air may be drawn into the chamber by the smoker, the arrangement being such that in operation aerosol precursor entering the chamber is converted into a condensation aerosol.

The aerosol precursor is preferably a liquid.

The second and third duct means may have separate entrances into the chamber. The second and third duct means may alternatively be provided by coaxial second and third ducts respectively having a common entrance into the chamber.

The third duct may be provided with a constricted region thereby to provide a pressure drop in air passing therethrough.

The third duct means may be a capillary.

There may be provided a fourth duct means between the container and the ambient air whereby pressure within the container may be equalised with that of the ambient air.

The means for heating the internal surfaces of the chamber is preferably provided by a heat source surrounding the chamber into which said mixture is introduced.

The invention will now be described by way of example only with reference to the following schematic non-scale sectional drawings in which FIGS. 1, 2 and 3 respectively show first, second and third embodiments of a smoking device according to the invention.

Referring to the first embodiment illustrated in FIG. 1 there is shown in longitudinal cross-section a pipe-like smoking device 10 comprising a cylindrical bowl member 12 divided into upper and lower compartments 14, 16 respectively by a partition 18, and a cylindrical mouthpiece 20 extending radially from the upper compartment through the cylindrical wall of the upper compartment. The upper end of the upper compartment 14 is provided with a protective fireproof cover 22 of porous or perforated material. The lower compartment 16 is closed at its lower end except for an air inlet 24.

A tube 26 extends axially between the upper and lower compartments 14, 16 through the partition 18. A further tube 27 provides communication between the interior of the upper end 28 of the tube 26, which is otherwise closed, and the mouthpiece 20. The upper end of the tube 26 is further surrounded by a heat-generating device 30, to be described hereinafter, adapted to heat the internal surfaces of the tube and consequently the contents of the tube. The lower end 32 of the tube 26, within the lower compartment 16, is open so that air may enter from the inlet 24, and is further provided with a constriction or venturi 34 so as to increase the velocity of air passing through the lower part of the tube and thereby decrease the air pressure within the tube upstream of the venturi.

Within the lower compartment 16 there is provided a flexible container 36 containing a liquid aerosol precursor the composition of which will be discussed in greater detail below. The container 36 is provided with an outlet duct, in the form of a capillary tube 38, leading into the tube 26 upstream of the venturi 34 at an inlet 39. The optimum diameter of the capillary 38 depends upon both the pressure drop across the venturi 34 and the viscosity of the aerosol precursor.

Figure 2:
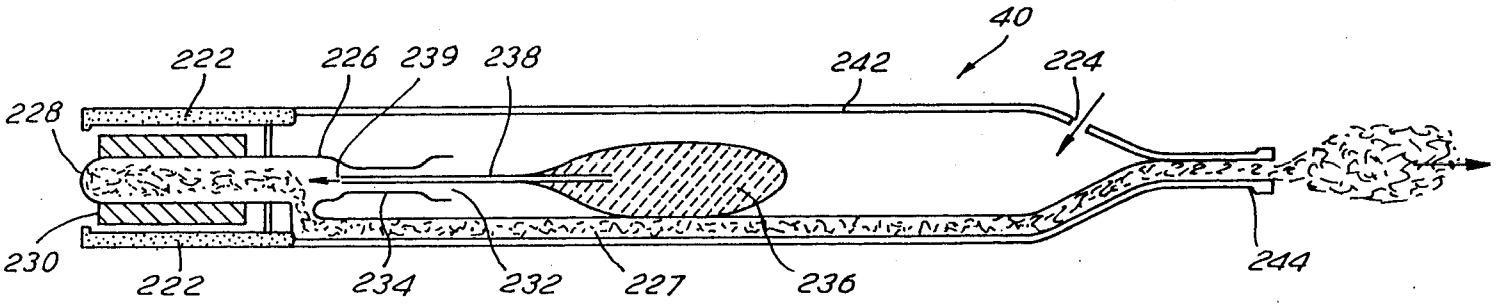

Referring to the second embodiment illustrated in FIG. 2 there is shown in longitudinal cross-section a cylindrical smoking device 40 resembling externally a traditional cigarette holder. The device 40 comprises an outer cylindrical pipe 242 open at both ends, one end tapering to a mouthpiece portion 244. That end of the outer cylindrical pipe 242 opposed to the mouthpiece 244 is provided with a protective tubular cover 222 of porous or perforated fireproof material. An aperture 224 is provided in the wall of the pipe 242 near the mouthpiece portion 244 so as to permit a flow of ambient air into the pipe.

An inner tubular member 226 supported by barrier 218, extends within the device 40 axially from the open end of the pipe 242 towards the mouthpiece 244. A further tube 227 provides communication between the interior of an end chamber portion 228 of the tube 226 distal to the mouthpiece 244, and the mouth end of the mouthpiece.

Accordingly, when a smoker draws on the device 40 through the mouthpiece 244 he is drawing on the contents of the end chamber 228 of tube 226. The barrier 218 may be porous or have holes, whence aperture 224 is not required.

The end chamber portion 228 is further surrounded by a heat-generating device 230, to be described hereinafter, adapted to heat the internal surfaces of the tube, and thereby the contents of the tube. The other end 232 of the tube 226 is open so that air may enter from the inlet 224 or through barrier 218 and is provided with a constriction or venturi 234 so as to increase the velocity of air passing through the tube and thereby decrease the air pressure within the tube upstream of the venturi.

Within the pipe 242 there is provided a flexible container 236 containing a liquid aerosol precursor the composition of which will be discussed in greater detail below. The container 236 is provided with an outlet duct, in the form of a capillary tube 238, leading into and through the tube 226 at its open end 232 to terminate upstream of the venturi 234 at an inlet 239 within end chamber 228. The diameter of the capillary 238 is chosen to match the pressure drop across the venturi 234 and the viscosity of the aerosol precursor.

Figure 3:
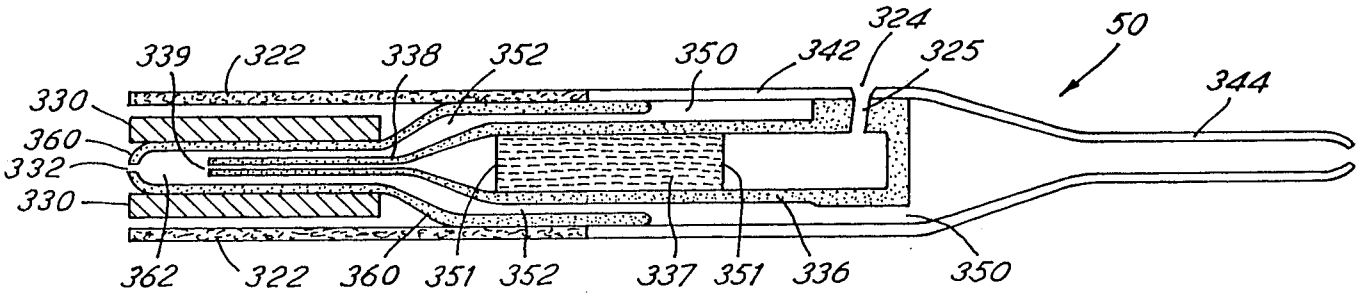

Referring to the third embodiment there is shown in FIG. 3 in longitudinal cross-section a cylindrical smoking device 50 resembling in its external features a traditional cigarette holder. The device 50 comprises an outer cylindrical pipe 342 open at both ends, one end tapering to a mouthpiece portion 344. That end of the outer cylindrical pipe 342 opposed to the mouthpiece 344 is provided with a protective tubular extension or cover 322 of porous or perforated fireproof material. Located axially within the pipe 342 but spaced therefrom by a cylindrical air channel 350 is a rigid cylindrical chamber 336 made of an incombustible and gas-impervious material closed at the end nearest the mouthpiece portion 344. An aperture 324 is provided in the wall of the pipe 342 near the mouthpiece portion 344. The aperture 324 permits equalisation of air pressure within the rigid cylindrical chamber 336 with ambient air and is typically of small radial dimensions, e.g. 1 mm diameter. The rigid cylindrical chamber 336 is provided at the end nearest the mouthpiece portion 344 with a duct 325 communicating with the aperture 324 in the wall of the pipe. The end of the chamber 336 distal to the mouthpiece portion 344 tapers to a capillary passage 338 terminating in an exit aperture 339 lying within the overall length of the pipe 342 and its protective extension 322.

Within the chamber 336, positioned between the duct 325 and the capillary passage 338 is a means 337 for providing an aerosol precursor, such as a porous body impregnated with volatilisable liquid aerosol precursor.

Surrounding the capillary passage 338 and a portion of the chamber 336 but spaced therefrom by a cylindrical airway 352 communicating with air channel 350 is an incombustible and gas-impervious chamber 360 which follows generally the contours of the chamber 336 and the constricted passage 338 so that that portion of chamber 360 which surrounds said portion of chamber 336 is in sealing contact with the inner face of the pipe 342 and its protective extension 322 whereas that portion of the chamber 360 surrounding the capillary passage 338 is spaced from the inner face of the extension 322. The chamber 360 is open at the end nearest the mouthpiece 344 and is provided at the end distal to the mouthpiece with an aperture 332 of about 0.84 mm diameter open to ambient air. That portion of the chamber 360 surrounding the capillary passage 338 provides a section 362 into which the exit aperture 339 discharges.

That end of the chamber 360 surrounding the capillary passage 338 is surrounded by a cylindrical heat generating device 330, to be described below, located within the protective extension 322 and adapted to heat the internal surfaces of that portion of the chamber 360 surrounding the capillary passage 338 and the capillary passage itself.

In operation of the embodiment of FIG. 3 the smoker draws on the mouthpiece 344 thereby creating a reduced pressure in chamber 362 with which the mouthpiece is in communication. The reduced pressure causes aerosol precursor to be drawn through the heated capillary passage 338 and to be propelled from the exit aperture 339 on to the heated internal surfaces of chamber 362. Aerosol precursor is thereby vaporised and the vapour is synchronously mixed with air that is caused by the reduced pressure in chamber 362 to be drawn into said chamber through aperture 332. The vapour and air mixture is drawn through the air way 352 into channel 350 and into mouthpiece 344 where cooling results in formation of a condensation aerosol. Hence aerosol is drawn into the smoker's mouth.

In the above embodiments the heat-generating device 30, 230, 330 is an exothermic material such as a mixture of inorganic solids which generate heat exothermically on ignition. Examples of such exothermic mixtures are mixtures of iron oxide and calcium silicide and mixtures of iron and sulphur.

The heat-generating device 30, 230, 330 may alternatively consist of a substance that relies on air oxidation for continued generation of heat after ignition. One example of such a substance is a carbonaceous mixture containing carbon, a binder such as xanthan gum, and an inorganic oxidizing agent such as potassium nitrate. One composition of the mixture contemplated is 2% potassium nitrate, 10% xanthan gum and 88% carbon.

Other examples of heat-generating substances include hydrogen, and gaseous or volatile hydrocarbons. Ambient air will be available through the open end of the device or through perforations or regions of porosity in the respective protective cover 22, 222 322, or, in the case of the first embodiment, through an aperture or apertures in the external wall of the upper compartment 14.

The aforesaid exothermic mixture, carbonaceous material, hydrogen or gaseous or volatile hydrocarbons may be adapted to be ignited by a heat source provided by the user.

The heat-generating device may include a primer or a friction element. Hydrogen may be ignited catalytically (by platinum/palladium catalyst), as may the gaseous or volatile hydrocarbons on warming.

An alternative embodiment of the heat-generating device 30, 230, 330 may be an electric heater powered by a battery. The electric heater, hydrogen and gaseous or volatile hydrocarbons may have puff actuated ignition.

The aerosol precursor within the flexible containers 36, 236 of respective FIGS. 1 and 2 comprises a liquid base having a boiling point in the range 100°–300° C., e.g. glycerol, propylene glycol, or sebacate esters such as di-2-ethylhexyl sebacate. The liquid base may also contain water, flavouring agents, nicotine or salts thereof.

When nicotine is incorporated in the aerosol precursor its concentration is chosen such that the level of nicotine in an aerosol produced from the precursor is similar to that attained by smokers when smoking conventional smoking products containing tobacco, e.g. in the range 20–200 micrograms per puff.

We claim:

1. A smoking device for releasing an aerosol into the mouth of a smoker, the device comprising in combination, (a) a chamber into which a mixture of air and an aerosol precursor is introduced, (b) a heating means external of the chamber for heating internal surfaces of the chamber, (c) a first duct providing communication between the chamber and a smoker's mouth, whereby the contents of the chamber may be drawn into the smoker's mouth, (d) a container for an aerosol precursor, (e) a second duct means leading from the aerosol precursor container into the chamber whereby aerosol precursor may pass from said container into the chamber, and (f) a third duct means providing communication between ambient air and the chamber whereby ambient air may be drawn into the chamber by the smoker, the arrangement being such that in operation aerosol precursor entering the chamber is converted into a condensation aerosol.

2. A smoking device as claimed in claim 1 wherein the aerosol precursor is a liquid.

3. A smoking device as claimed in claim 1 wherein the container for the aerosol precursor is a flexible container.

4. A smoking device as claimed in claim 1 wherein the second and third duct means are provided by second and third ducts respectively, having separate entrances into the chamber.

5. A smoking device as claimed in claim 1 wherein the second and third duct means are provided by coaxial second and third ducts respectively having a common entrance into the chamber.

6. A smoking device as claimed in claim 1 wherein the third duct is provided with a constricted region thereby to provide a pressure drop in air passing therethrough.

7. A smoking device as claimed in claim 1 wherein a fourth duct means is provided between the container and the ambient air whereby pressure within the container may be equalised with that of the ambient air.

8. A smoking device as claimed in claim 1 wherein the means for heating the mixture of aerosol precursor and air is provided by a heat source surrounding the chamber containing said mixture.

9. A smoking device as claimed in claim 8 wherein the heat source is provided by an exothermic material.

10. A smoking device as claimed in claim 9 wherein the exothermic material is an exothermic mixture of inorganic solids.

11. A smoking device as claimed in claim 10 wherein the exothermic mixture is a mixture of iron oxide and calcium silicide.

12. A smoking device as claimed in claim 10 wherein the exothermic mixture is a mixture of iron and sulphur.

13. A smoking device as claimed in claim 8 wherein the heat source is provided by a substance that relies on oxidation by air for continued generation of heat after ignition.

14. A smoking device as claimed in claim 13 wherein the substance is a carbonaceous material.

15. A smoking device as claimed in claim 14 wherein the carbonaceous material is a mixture including carbon and an inorganic oxidizing agent.

16. A smoking device as claimed in claim 15 wherein the oxidizing agent is potassium nitrate.

17. A smoking device as claimed in claim 16 wherein the composition of the mixture is 2% potassium nitrate, 88% carbon, and 10% binder.

18. A smoking device as claimed in claim 13 wherein the substance is selected from the group comprising hydrogen and gaseous or volatile hydrocarbons.

19. A smoking device as claimed in claim 8 wherein the heat source is provided by a battery powered electric heater.

20. A smoking device as claimed in claim 1 wherein the aerosol precursor comprises a liquid base having a boiling point in the range 100°–300° C.

21. A smoking device as claimed in claim 20 wherein the liquid base is selected from the group consisting of glycerol, propylene glycol, and sebacate esters.

22. A smoking device as claimed in claim 21 wherein the sebacate ester is di-2-ethylhexyl sebacate.

23. A smoking device as claimed in claim 21 wherein the liquid base further contains nicotine or a salt thereof.

* * * * *